US009757869B1

(12) United States Patent
Wada et al.

(10) Patent No.: US 9,757,869 B1
(45) Date of Patent: Sep. 12, 2017

(54) ELECTRIC SCISSORS

(71) Applicants: Yoshikazu Wada, Sakai (JP); Lawrence Y Igarashi, Coto De Caza, CA (US)

(72) Inventors: Yoshikazu Wada, Sakai (JP); Lawrence Y Igarashi, Coto De Caza, CA (US)

( * ) Notice: Subject to any disclaimer, the term of this patent is extended or adjusted under 35 U.S.C. 154(b) by 0 days.

(21) Appl. No.: 15/388,211

(22) Filed: Dec. 22, 2016

(51) Int. Cl.
*B26B 15/00* (2006.01)

(52) U.S. Cl.
CPC ..... *B26B 15/00* (2013.01)

(58) Field of Classification Search
CPC ..... B26B 15/00
USPC ..... 30/228
See application file for complete search history.

(56) References Cited

U.S. PATENT DOCUMENTS 2,740,197 A * 4/1956 Padva ..... B26B 15/00 30/228
3,478,426 A 11/1969 Greene
3,536,976 A * 10/1970 Weidauer ..... A01G 3/053 30/228
3,583,067 A * 6/1971 Briskman et al. ..... B25F 3/00 192/33 R
3,631,596 A * 1/1972 Glaus ..... B26B 15/00 30/228
3,787,742 A * 1/1974 Murphy ..... B26B 15/00 200/332.2
4,682,416 A * 7/1987 Stolfa ..... B23D 29/005 30/228
5,002,135 A 3/1991 Pellenc
5,918,371 A * 7/1999 Herrmann ..... B25B 7/12 30/246
6,044,564 A 4/2000 Jeltsch
6,226,875 B1 * 5/2001 Lii ..... A01G 3/067 30/228
6,367,156 B1 * 4/2002 Herrmann ..... B25B 7/12 30/228
6,973,727 B2 12/2005 Yao
7,331,109 B2 2/2008 Tu
2005/0160606 A1 7/2005 Yao
2012/0011729 A1 1/2012 Kim et al.
2013/0019481 A1 1/2013 Yamaoka et al.

* cited by examiner

*Primary Examiner* — Hwei C Payer
(74) *Attorney, Agent, or Firm* — Steven A. Nielsen; www.NielsenPatents.com

(57) ABSTRACT

An electric trimming device (100) achieves mechanical advantages by use of a rotational assembly (600) creating an offset rotation used to move a movable blade (350) in a back and forth series of movements. Thus, traditional rotational movement from an electric motor is efficiently translated into a reciprocating scissor type movement. A moveable blade (350) defines a longitudinal void (360) the void used to retain a sliding pin (616) with a scissor blade bearing (618) rotating around the sliding pin. The sliding pin is attached to outer portions a radial rotational plate (610) with an inner portion of the plate attached to an axle of a motor. To achieve a smooth planar movement of the moveable blade the radial rotational plate spins in and out of a guide assembly (700).

8 Claims, 13 Drawing Sheets

ELECTRIC SCISSORS

RELATED PATENT APPLICATION AND INCORPORATION BY REFERENCE

NA

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION (1) Field of the Invention

The invention generally relates to electrically operated scissors. More particularly, the invention relates to the use and construction of electrically powered trimers, sometimes used to trim plant life.

(2) Description of the Related Art

U.S. Pat. No. 7,331,109 issued on Feb. 19, 2008 to Tu discloses an electric cutting device using a bulky system comprising multiple housings and multiple rods.

U.S. Published Patent Application 2005/0160606 of Yao published on Jul. 28, 2005 uses a driving disk, an axial rod and crank to convert the rotation of an electric motor to move a scissor or movable knife. The Yao design suffers many shortfalls, including a large form factor in the upper casing and imposes an inefficient angle between the driving disk and the crank requiring extra width in the external form factor. Another shortfall with the Yao design is that rotational or lateral forces are exerted upon the driving arm of the movable knife, causing a twisting of the driving arm diminishing the life expectancy of the movable knife and fouling the cutting angle between the movable knife and the stationary knife. Thus, there is room in the art for the disclosed embodiments.

BRIEF SUMMARY OF THE INVENTION

The present invention overcomes shortfalls in the related art by presenting an unobvious and unique combination, configuration and use of moving blade pivotally attached to a fixed blade with the moving blade moved in a back and forth planar movement by use of a rotational assembly guided or contained within a guide assembly. A rotational assembly may comprise a radial rotational disc attached to a raised axial hub with the raised axle hub rotated by a center axle or center point of a motor.

A sliding pin may be disposed near or adjacent to a trailing edge of the radial rotational disc with the sliding pin in sliding attachment within a longitudinal void of the moving blade. The offset between the raised axle hub and the sliding pin creates a rotational advantage causing the moving blade to move back and forth with respect to the fixed blade. The back and forth movement of the moving blade occurs along a flat plane with respect to the raised axle hub, the presently disclosed embodiments overcome the shortfalls of the Yao design.

The disclosed embodiments overcome shortfalls in the art by use of a guide assembly wherein a horizontal guide void accepts the radial rotational disc to keep the moving blade in a proper plane with respect to the fixed blade.

The disclosed embodiments overcome shortfalls in the art by use of a longitudinal void that accepts the sliding pin such that force is applied directly to the moving blade along the flat plane of the blade, thus there are no twisting or torqueing forces applied to the moving blade which is in direct contraction to the Yao design.

The disclosed embodiments overcome shortfalls in the art by providing an electrically powered set of scissors or a set of plant trimmers in a pistol form factor with a trigger guard and trigger control for variable speed cutting with single cut modes and continuous cutting modes. An emergency stop function immediately releases the blades from the closed position to a safe open position which provides a mechanical advantage of opening the blades for safety purposes, in the event a user cuts their finger by mistake, the blades will not remain in the cut finger.

In factory or indoor applications, and AC adapter may be used to power the device for unlimited amounts of time. An optionally supplied external rechargeable battery pack may be used to power the device and may be worn upon a belt or shoulder harness of a cutter.

Disclosed embodiments overcome shortfalls in the art by use an interchangeable blade assembly system allowing cutting blades to be easily replaced.

Disclosed embodiments overcome shortfalls in the related art by reliving or reducing a trimmer's tendinitis, arthritis and muscle pain and by increasing the speed of trimming.

Disclosed embodiments overcome shortfalls in the art by use of one or more spring rivets to urge the blades to one another such that both blade edges meet tightly to increase cutting efficiency. The blade attachment system mimics the intuitive action or oppositional forces of human fingers squeezing blades tightly against one another to increase cutting power.

The unique blade movement using an offset axis of blade rotation overcomes shortfalls in the related art by providing trimming of uniform speed and quality. Cutting blades may be coated in anti-bacteria material and fluorine to minimize bacteria growth.

REFERENCE NUMERALS IN THE DRAWINGS

Figure 2:
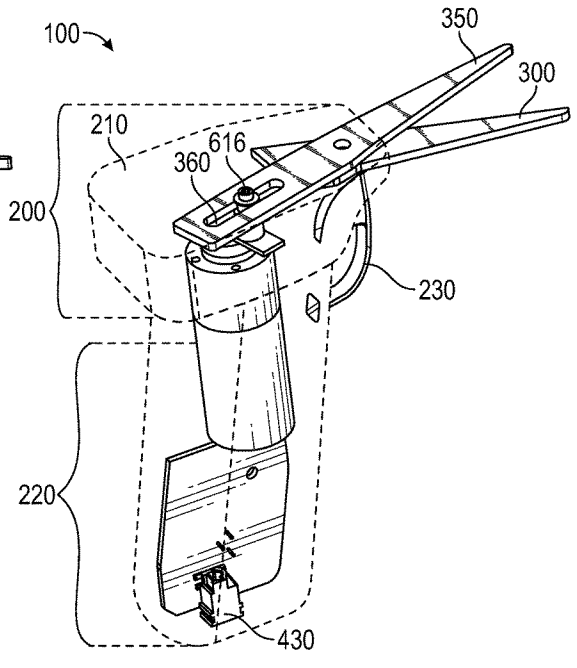
FIG. 2 is a perspective view of a disclosed embodiment

100 a disclosed embodiment in general
200 upper casing

210 top cover of upper casing
220 lower casing
230 trigger guard
240 trigger
300 fixed blade
310 base section of fixed blade
312 attachment voids of base section 310
314 fixed blade pivot void
315 longitudinal body of fixed blade 300
320 cutting edge section of fixed blade 300
350 moveable blade
353 distal end of moveable blade 350
356 proximal end of moveable blade 350
358 lowered trailing edge of moveable blade
359 longitudinal body section of moveable blade 350
360 longitudinal void defined within longitudinal body section 359
363 pivot void defined within center section of moveable blade 350
364 spring washer, disposed within the pivot void 363
365 scissor blade pivot rivet, disposed within pivot void 363
366 cutting edge section of moveable blade 350
400 electronics board
430 receptacle for external power
460 auxiliary or external power supply or battery
500 motor
600 rotational assembly
610 radial rotational plate
612 positional flag on radial rotational plate 610
613 circumferential edge of radial rotational plate 610
614 radially extending leading edge of radial rotational plate
615 radially extending trailing edge of radial rotational plate
616 sliding pin of radial rotational plate
617 sliding pin cap, retains the moveable blade 350
618 scissor blade bearing, rotates over the sliding pin 616
624 raised axle hub centrally disposed upon the motor
700 guide assembly
710 lower horizontal shelf of guide assembly
720 horizontal guide void defined between lower horizontal shelf 710 and
upper horizontal shelf 730
730 upper horizontal shelf of guide assembly
735 sensor within the guide assembly 700, used to sense or report the position of a positional flag 612

These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

Figure 1:
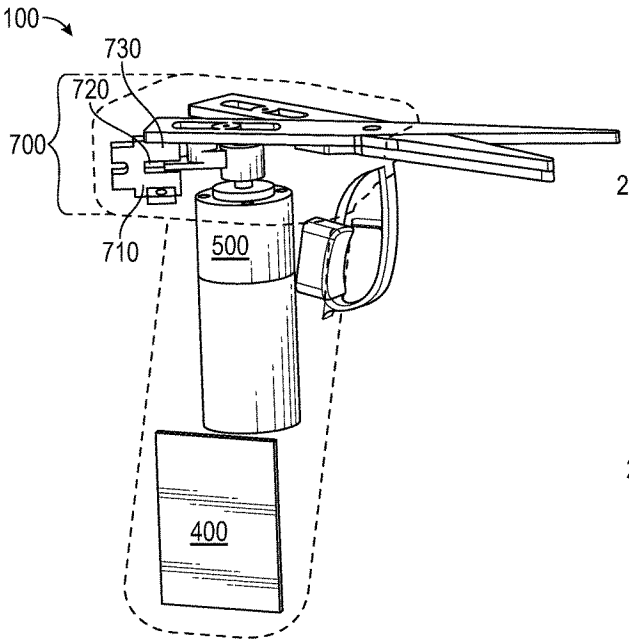
FIG. 1 is a perspective view of a disclosed embodiment

Referring to FIG. 1, a disclosed embodiment may comprise a fixed blade and a movable blade with the movable blade moved by a unique offset system. A guide assembly 700 provides a mechanical advantage in keeping the radial rotational disc in a true horizontal plane to avoid the blade twisting shortfalls of the Yao design discussed above. A guide assembly 700 may comprise a horizontal guide void 720 defined by a lower 710 and upper 730 horizontal shelf. Disclosed embodiments may include an electric motor 500 powered by an external power supply to reduce the weight of the device. Control of motor speed and periods of motor operation may be controlled by an electronics board 400.

Referring to FIG. 2, a fixed blade 300 is shown in fixed attachment to the body of the device. A movable blade 350 may rotate upon or in relation to the fixed blade. To urge the opening and closing of the movable blade a sliding pin 616 may slide upon or within a longitudinal void 360 of the movable blade The outer body of a disclosed trimmer may comprise a removable top cover 210 which may be part of an upper casing 200 with the upper casing attached to and superior to a lower casing 220. The device may include a trigger guard 230.

Figure 3:
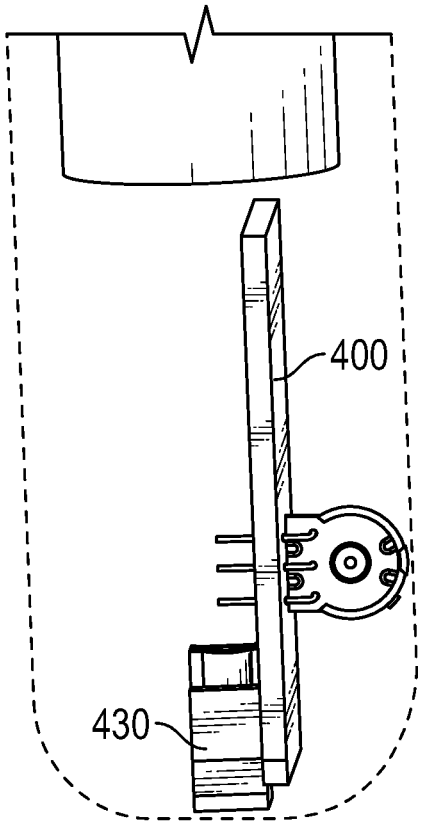
FIG. 3 is a perspective view of disclosed components

FIG. 3 depicts an electronics board 400 sometimes attached to a receptacle 430 for external power.

Figure 4:
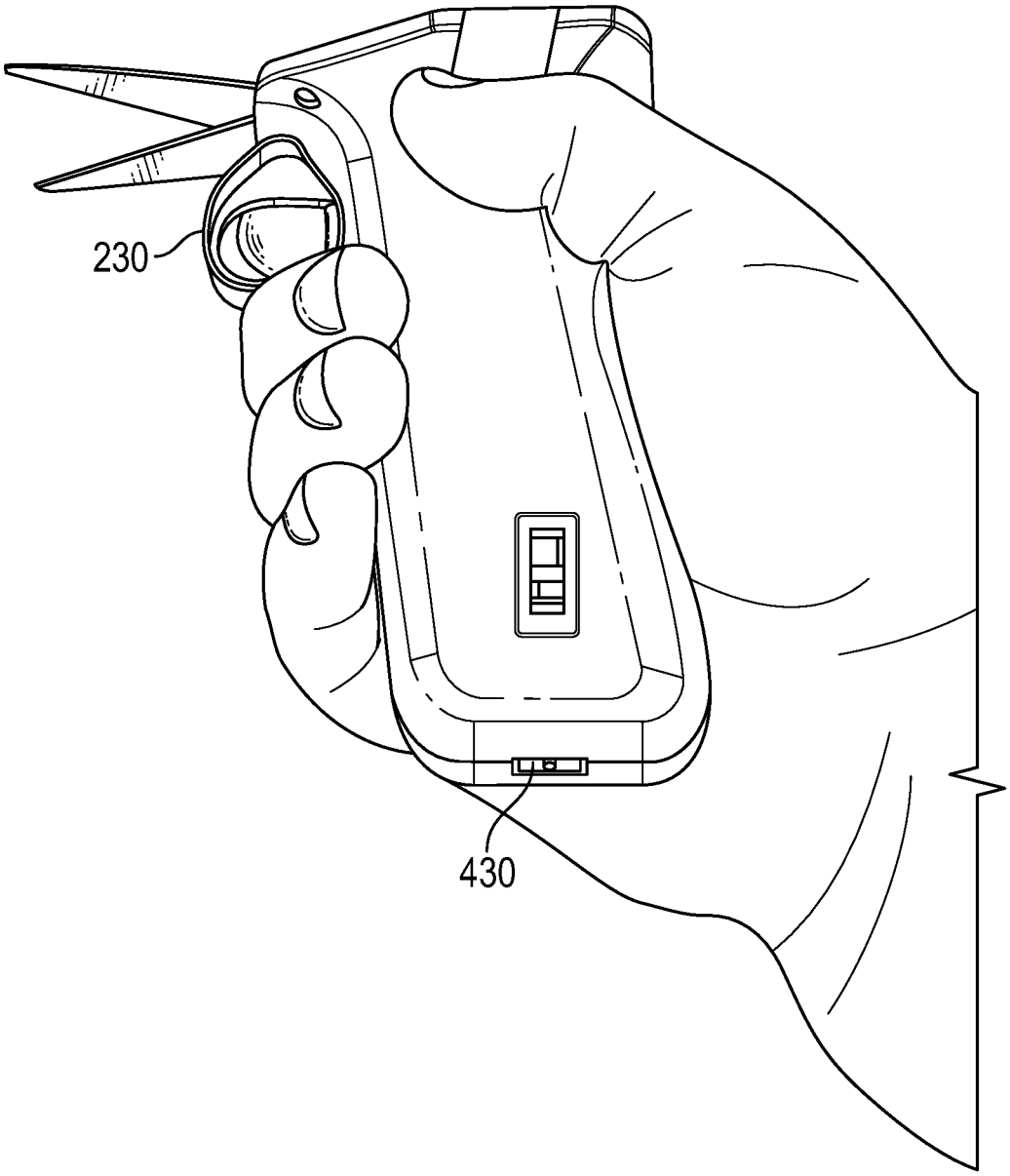
FIG. 4 is a perspective view of a disclosed embodiment

FIG. 4 depicts a pistol grip form factor and illiterates the bottom end or inferior end of a receptacle 430 for external power.

Figure 5:
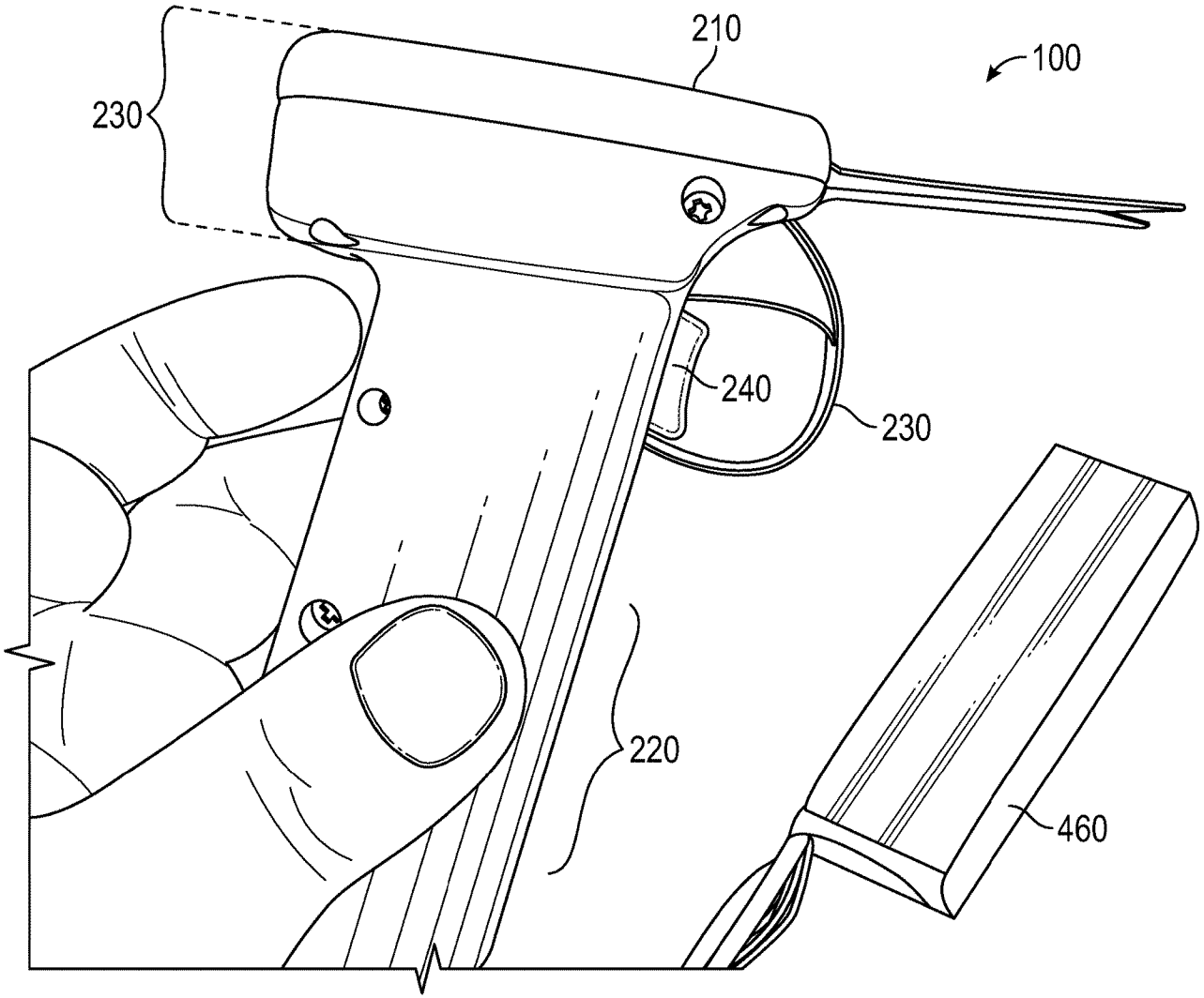
FIG. 5 is a perspective view of a disclosed embodiment with an optional auxiliary power pack

FIG. 5 depicts an ancillary power supply 460 attached to a disclosed device. The ancillary or auxiliary power supply 460 may be worn upon a belt or shoulder strap of a user. An advantage of the disclosed trimmer is that weight is reduced by not having a battery contained within the device.

Figure 6:
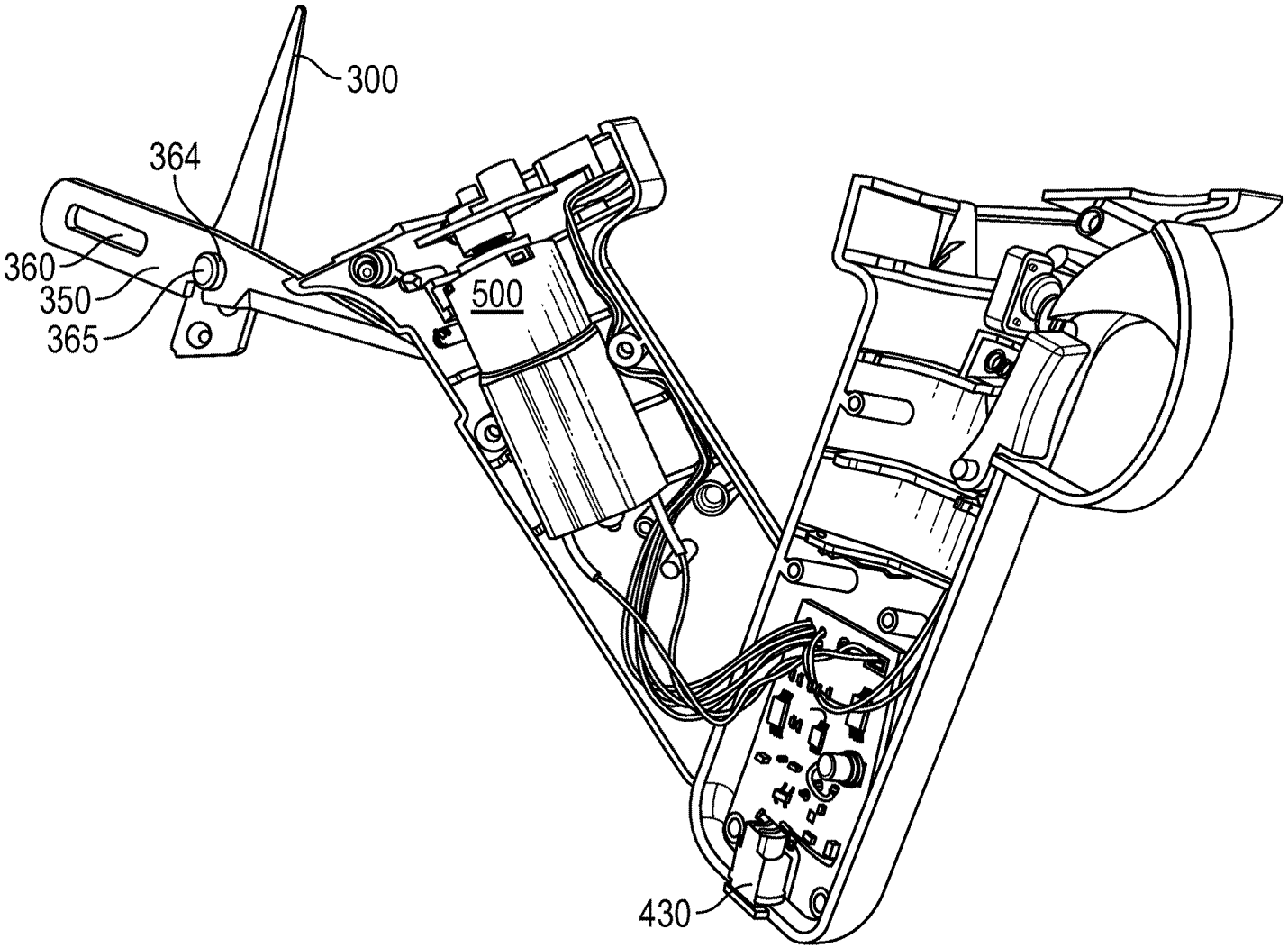
FIG. 6 is a perspective view of disclosed components

FIG. 6 depicts internal wiring of the device and other components. A scissor blade pivot pin 365 may be disposed within a pivot void of the moveable blade. A spring washer 364 may be disposed around the scissor blade pivot pin 365 and above the moveable blade 350 so as to urge the moveable blade down upon the fixed blade 300. The configuration provides mechanical advantages in that the spring washer creates an improved cutting action by keeping the moveable bladed pressured upon the fixed blade. This is an advantage over the prior art in that with prior art scissors a user is forced to apply blade pressure by hand to keep the blades pressed upon one another.

Figure 7:
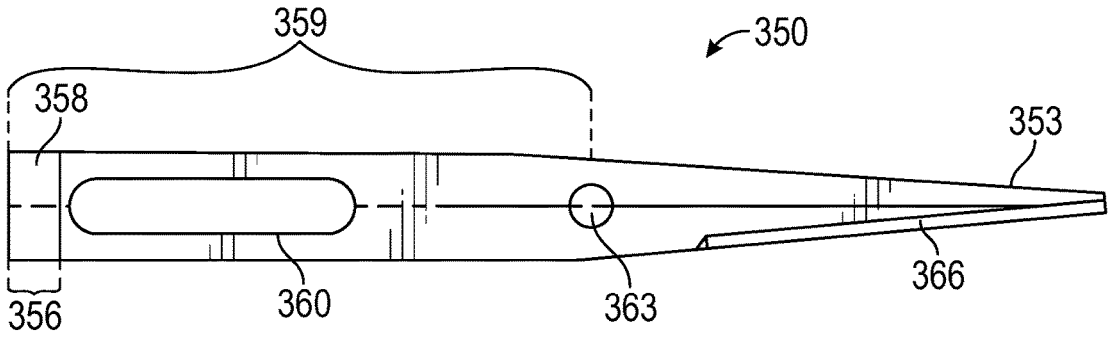
FIG. 7 is a top plan view of a moveable blade

FIG. 7 depicts a plan view of a movable blade 350 with a movable blade sometimes comprising a longitudinal body section 359 which may define a longitudinal void 360. A movable blade may further comprise or define a pivot void 363, a cutting edge and a distal end 353. A movable blade may further comprise a proximal end 356 which may comprise a lowered trailing edge 358. The lowered trailing edge of the blade may provide a mechanical advantage in keeping a low profile or in the savings of blade weight. The pivot void 363 of movable blade may align with the fixed blade pivot void (shown as 314 in FIG. 10), such that, as shown in FIG. 6, a scissor blade pivot pin 365 and spring washer 364 may be disposed within the two blade voids to facilitate cutting between the blades.

Figure 8:
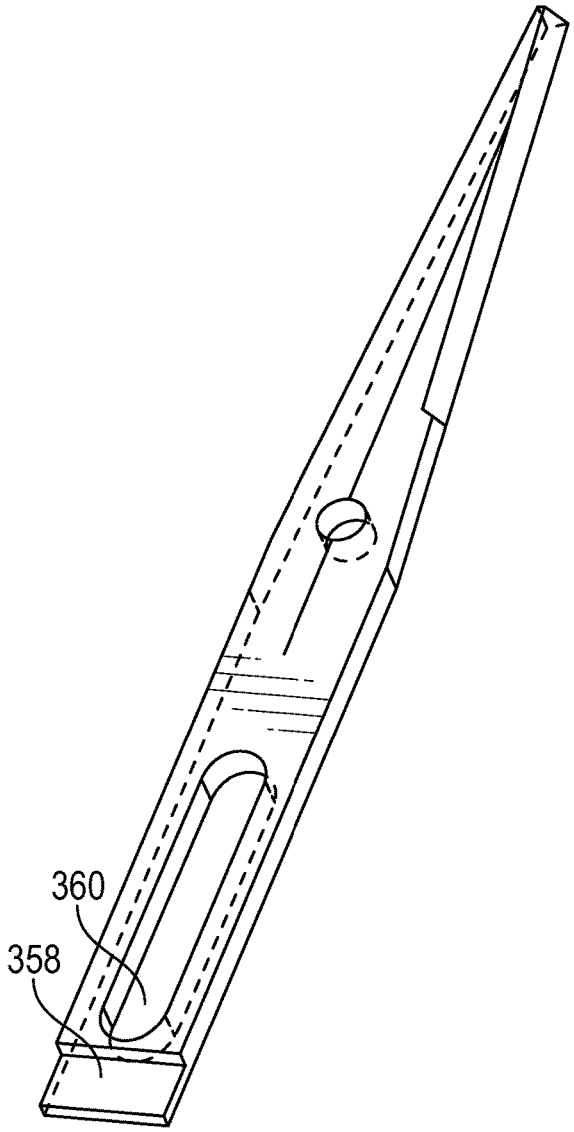
FIG. 8 is a perspective view of a moveable blade

FIG. 8 depicts a perspective view of a movable blade.

Figure 10:
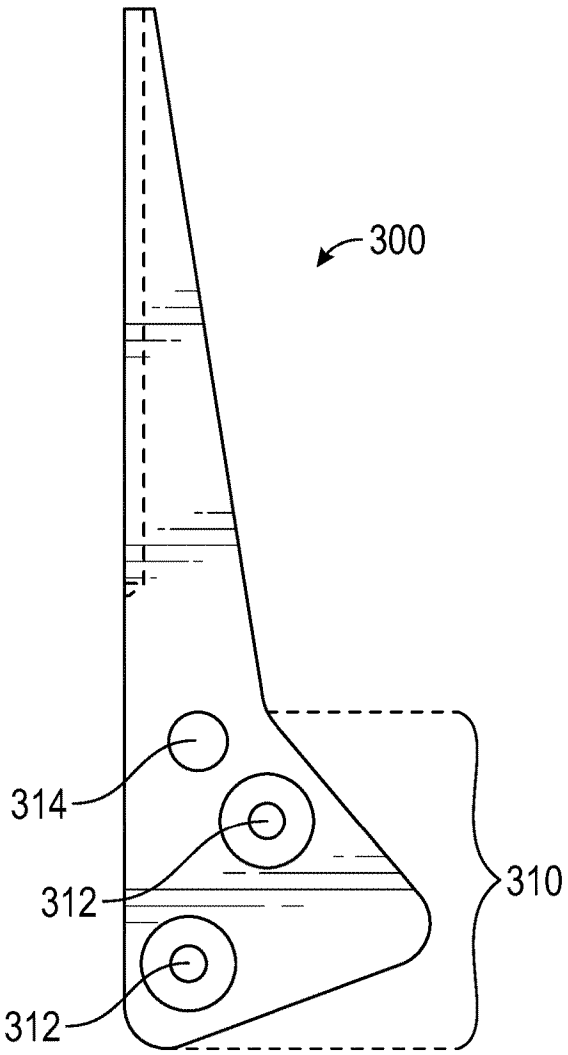
FIG. 10 is a bottom perspective view of a fixed blade
Figure 9:
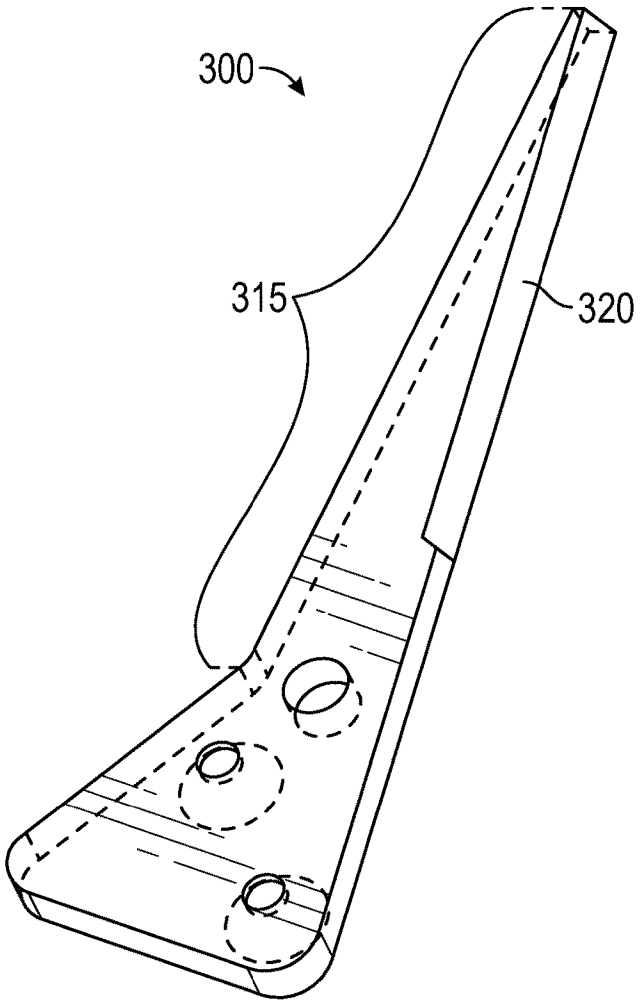
FIG. 9 is a top perspective view of a fixed blade

FIG. 9 and FIG. 10 depict various attributes of a fixed blade 300. A base section 310 may provide a mechanical advantage in defining a plurality of attachment voids 212 and a fixed blade pivot void 314, the fixed blade pivot void may be used to secure a scissor blade pivot pin within a void of the movable blade. The base section 310 may be attached to or connected to a longitudinal body 315 and the longitudinal body may comprise a cutting edge 320.

Figure 11:
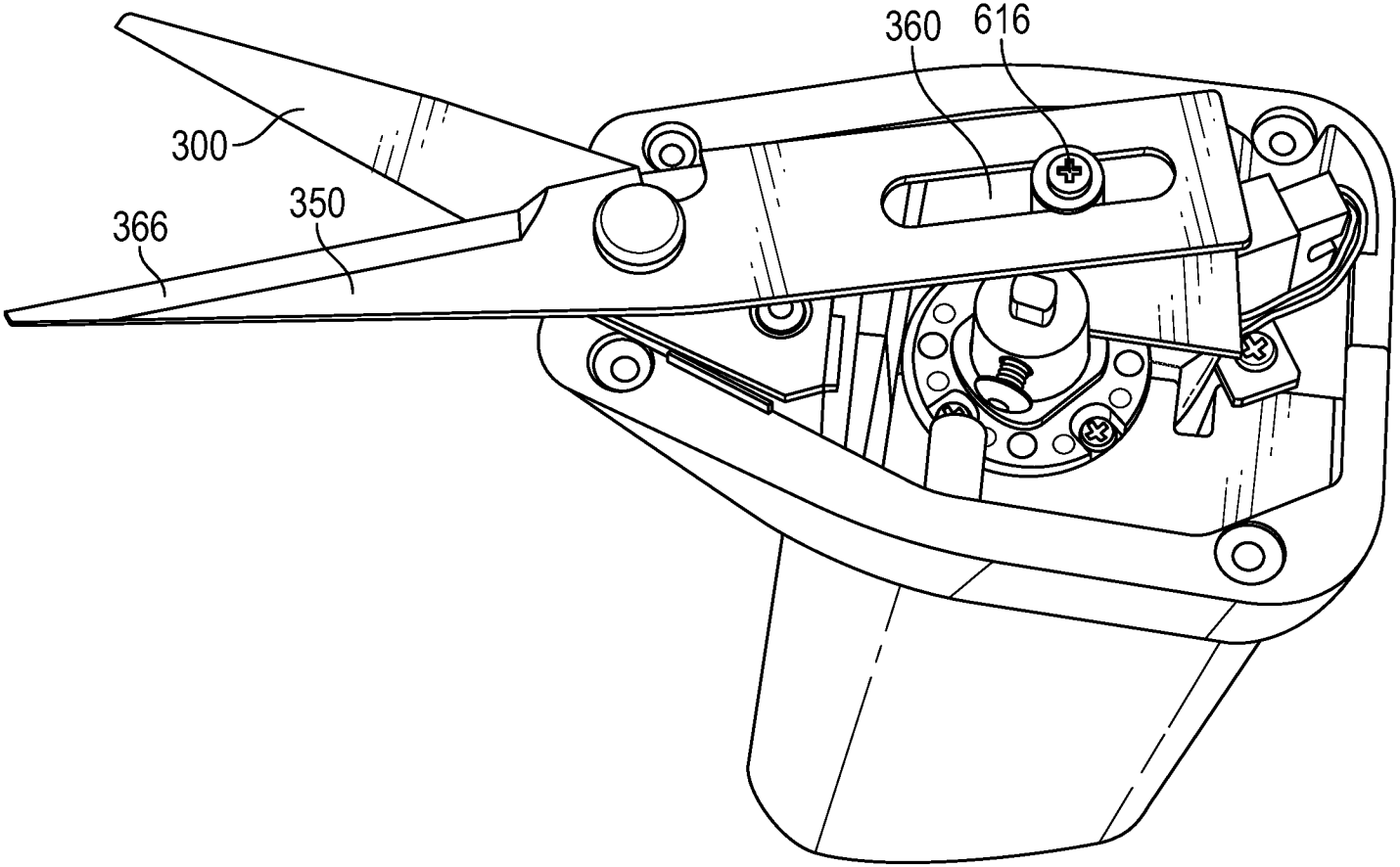
FIG. 11 is a top perspective view of disclosed components

FIG. 11 depicts a top perspective view of a disclosed embodiment with the top cover removed so as to expose a fixed blade 300 and a movable blade 350 with a sliding pin 616 disposed within the longitudinal void 360 of the movable blade.

Figure 12:
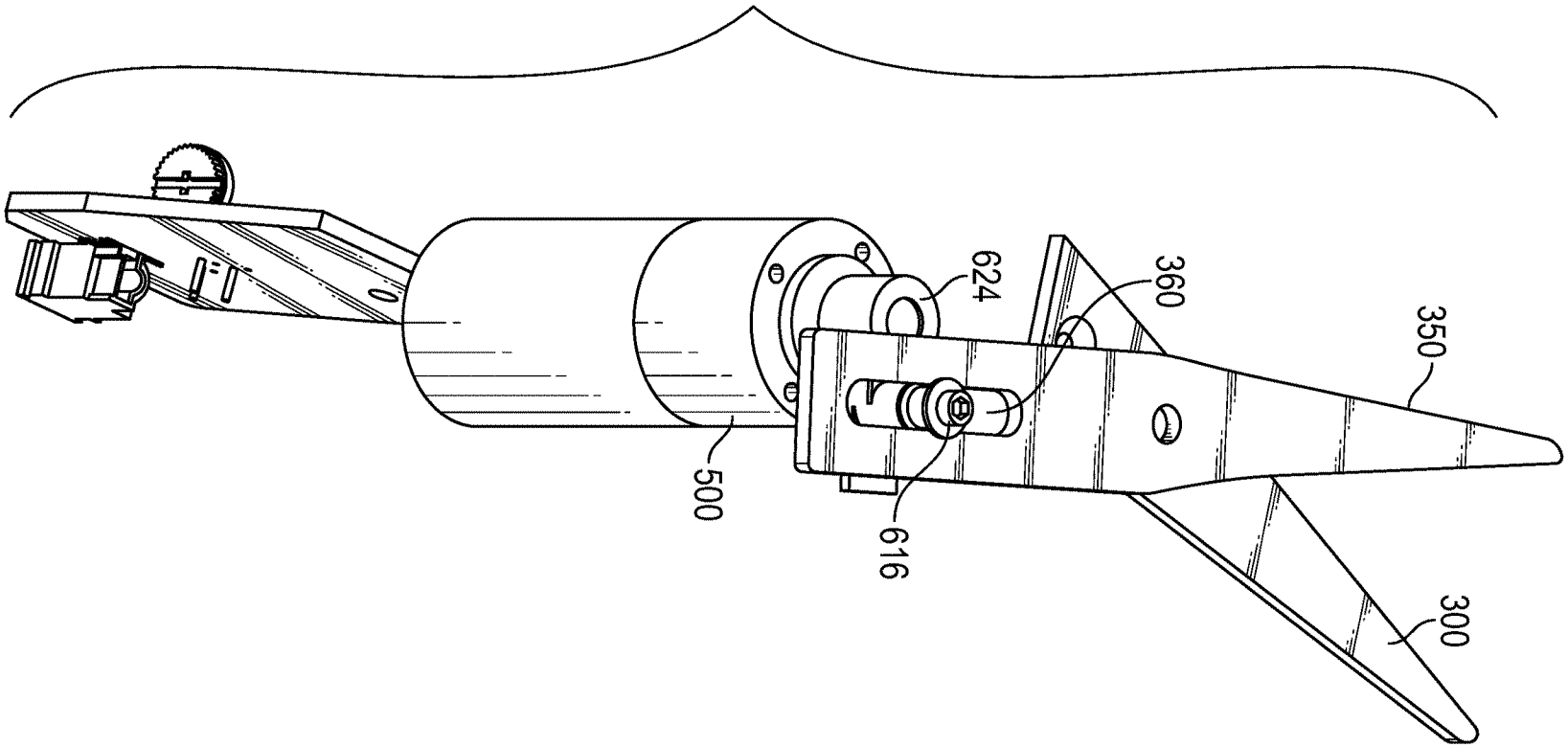
FIG. 12 is a top perspective view of disclosed components

FIG. 12 depicts various components such as a fixed blade 300 positioned under a movable blade 350. A raised axle hub 624 is shown near a sliding pin 616.

Figure 13:
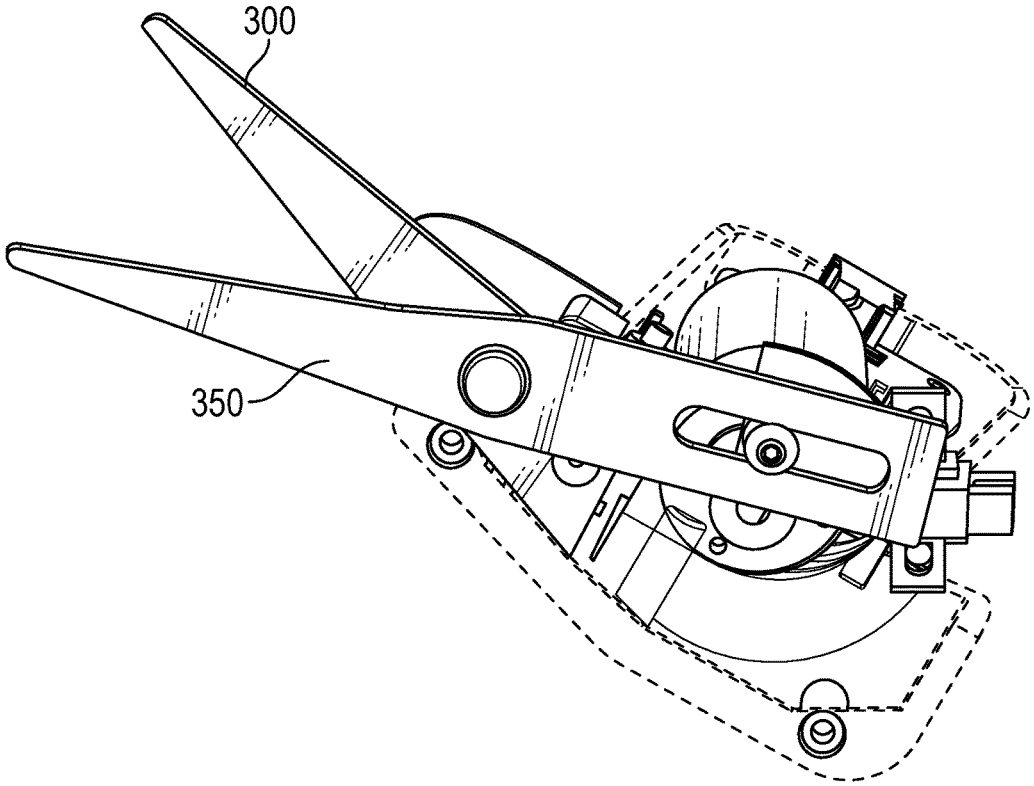
FIG. 13 is perspective view of disclosed components

FIG. 13 depicts a movable blade on top of a fixed blade.

Figure 14:
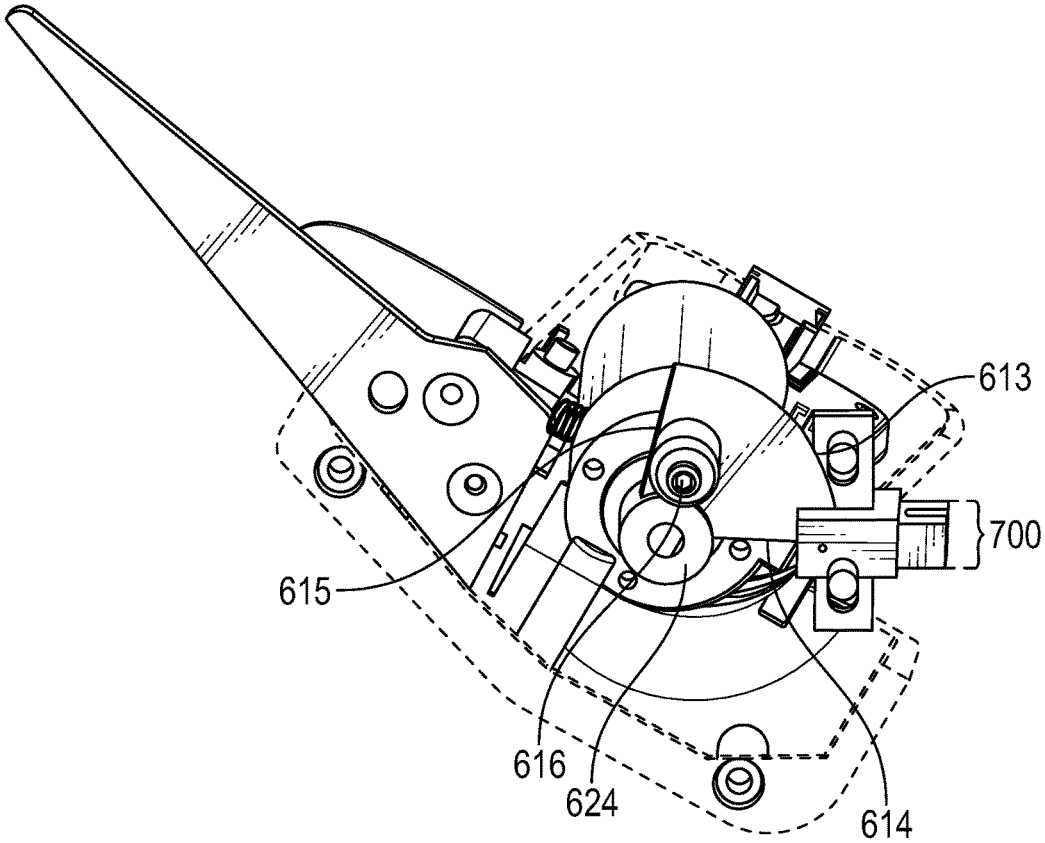
FIG. 14 is a perspective view of disclosed components

FIG. 14 depicts a fixed blade but omits a movable blade in order to more clearly show a raised center hub 624 attached to a radial rotational plate 610 with the radially extending leading edge 614 of the radial rotational plate entering the guide assembly 700. The guide assembly 700 may comprise one or more sensors, the sensors used to report the position of the radial rotational plate 610. Such a sensor is shown on FIG. 15.

Figure 15:
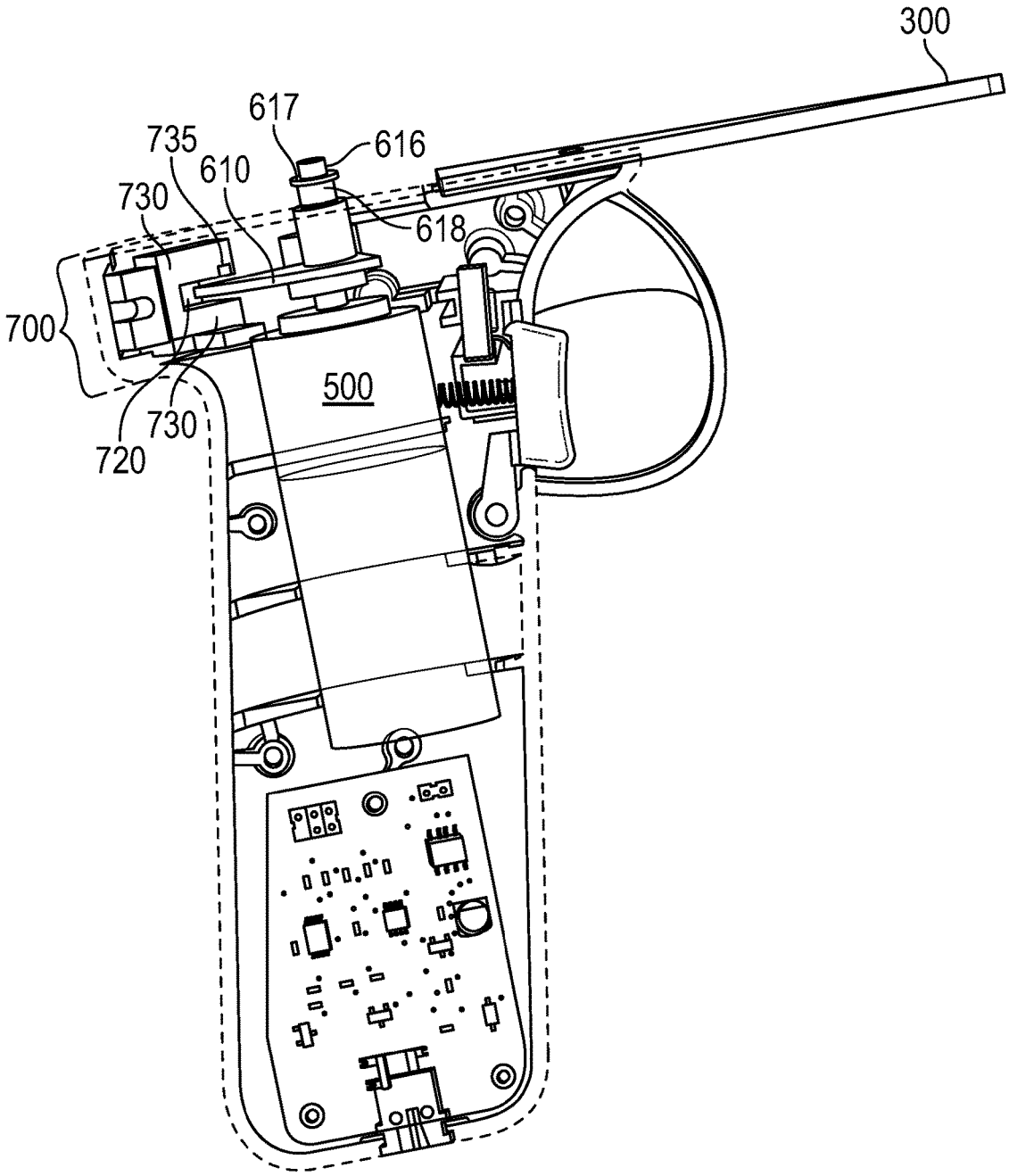
FIG. 15 is a perspective view sectional view of disclosed components
Figure 17:
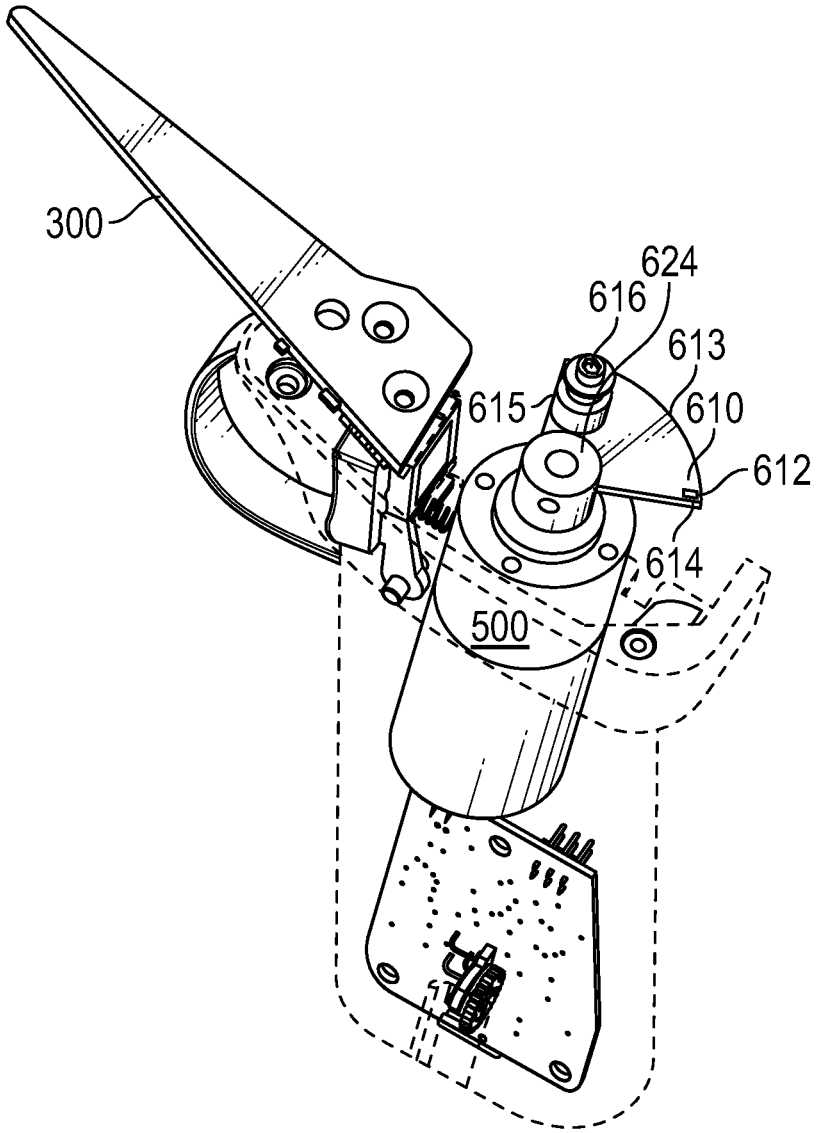
FIG. 17 is a top perspective view of disclosed components

FIG. 15 depicts a cross sectional view of various components. The radial rotational plate 610 is shown entering the horizontal guide void 720 of the guide assembly 700. This feature provides a mechanical advantage in keeping the movable blade in a planar pattern of movement such that the movable blade stays true to the fixed blade. The guide assembly 700 also overcomes shortfalls in the art by the placement and retention of one or more sensors 735 used to sense and to report the position of a positional flag, such as the positional flag shown in FIG. 17. Referring to FIG. 17, the positional flag 612 may be located at or near the radially extending leading edge 614 of the radial rotational plate 610 such that when the sensor and positional flag are aligned, the blades are in an open position, which is an ideal stopping position for safety reasons as discussed above. The relative positions between the sliding pin 616 located upon or near the radially extending trailing edge 615 and the positional flag located upon the radially extending leading edge 614 provides a mechanical advantage in that the open position of the scissors is reported when the radial rotational plate 610 is just entering the guide assembly 700 so as to keep in the movable blade in planar alignment in an open and resting state.

Figure 16:
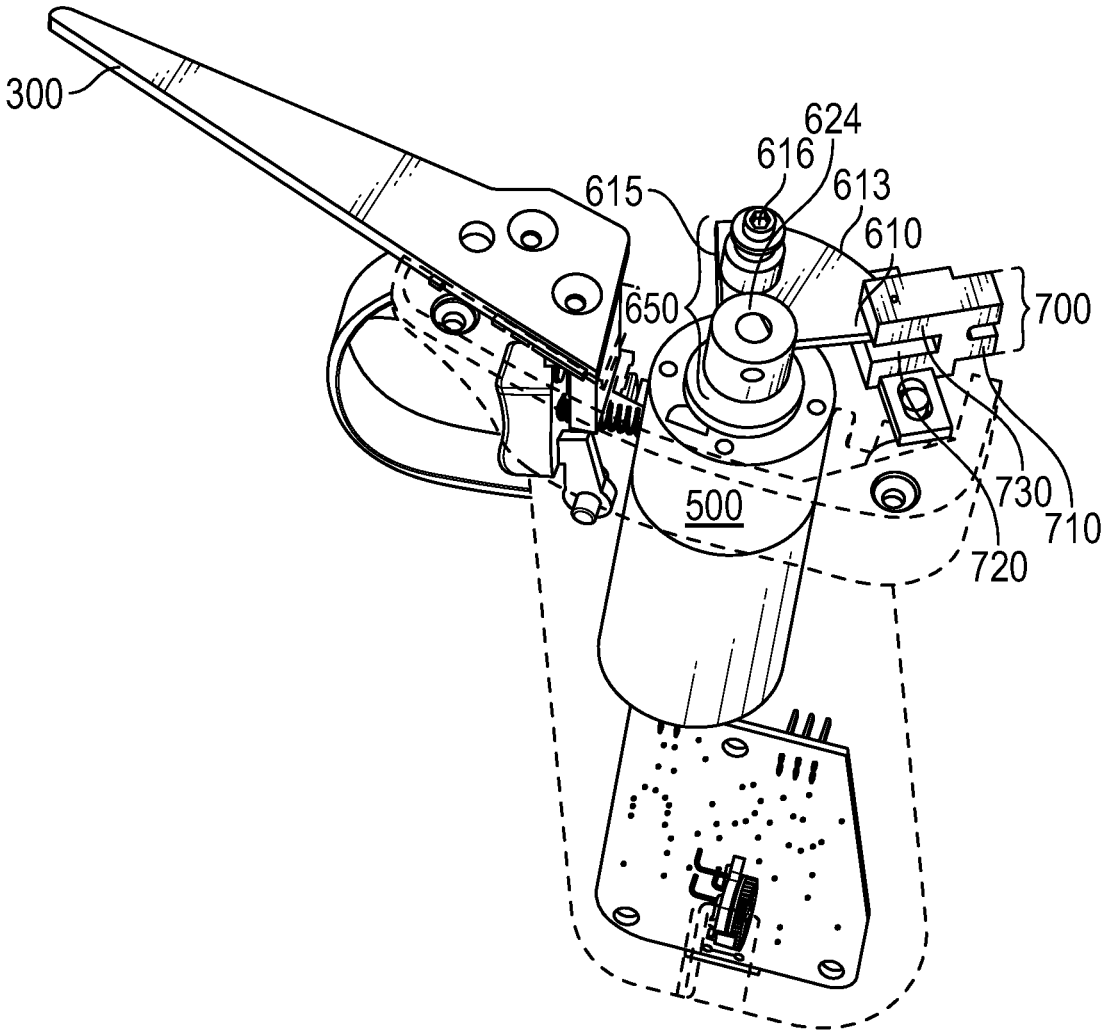
FIG. 16 is a top perspective view of disclosed components

FIG. 16 further depicts disclosed features that provide mechanical advantages, such as the sliding pin 616 being disposed near to or adjacent to the radially extending trailing edge 615 of the radial rotational plate 610 in that the radially extending leading edge will be in the guide assembly to keep the movable blade in planar position during the cutting process.

FIG. 17 further depicts the offset distance between the raised axle hub and the sliding pin 616. This distance creates the smooth and precise movement of the movable blade. A positional flag 612 or beacon may be disposed upon the radial rotational plate so as to report the position of the movable blade as discussed above.

The connection arm or radial rotational plate 610 may be attached to a scissor blade bearing 618 and/or sliding pin 616 with the scissor blade bearing and/or sliding pin 616 disposed within the slot or longitudinal void 360 defined within the moving blade or moveable blade 350. The sliding pin 616 moving within the void or slot of the moving blade causes the moving blade to move back and forth and in opposition with the fixed blade. The scissor blade bearing 618 may rotate around the sliding pin as the sliding pin moves the movable blade back and forth. The scissor blade bearing overcomes shortfalls in the art by reducing friction between the sliding pin and walls of the longitudinal void 360 of the movable blade.

The connection arm or radial rotational plate 610 may be equipped with a flag that is rotated to a sensor when the movable blade reaches an open position. A control circuit can stop the blade in this position if the trigger position is in the open position. If the trigger position is in the closed position the motor will continue to rotate and cycle the moveable blade to the open position. Such a system has a mechanical advantage of keeping the blades free of debris by not trapping debris between the blades in a closed blade position. If the blade stops cutting and does not open, the flag will not reach the sensor and then the circuit controller will stop electrical power to the motor and not turn back on again until the trigger is released to open and then closed again. This allows the operator to clear anything blocking the blades from closing.

An optional fan may be added to blow air out of the case and across the blades. Such an air flow may reduce plant debris and oil from fouling the void of the movable blade.

The motor may be powered by an external power supply, such as a love voltage power supply. The motor may also be powered by use of an 110V AC adopter or converter. In order to save weight, a disclosed embodiment may be devoid of an internal battery.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. An electrically operated device (100) for cutting, the device comprising:

a) an upper casing (200) in fixed attachment to a fixed blade (300), the fixed blade comprising a base section (310) attached to a longitudinal body (315) with the fixed blade defining a fixed blade pivot void (314) and a plurality of attachment voids (312);

b) a moveable blade (350) comprising a longitudinal body section (359) defining a longitudinal void (360), the moveable blade further defining a pivot void (363);

c) an electric motor (500) having a rotational axle attached to a raised axle hub (624) with the raised axle hub attached to a radial rotational plate (610);

d) the radial rotational plate comprising a planar top surface and a planar bottom surface, a radially extending trailing edge (615), a circumferential edge (613) and a radially extending leading edge (614);

e) a sliding pin (616) disposed upon the radial rotational plate, with a scissor blade bearing (618) disposed around the sliding pin;

f) a guide assembly (700) in fixed attachment to the upper casing, the guide assembly defining a horizontal guide void (720);

g) the sliding pin and the scissor blade bearing disposed within the longitudinal void of the moveable blade; and h) a scissor blade pivot pin (365) disposed within the fixed blade pivot void and the pivot void of the moveable blade.

2. The device of claim 1 further including a spring washer (364) disposed around the scissor blade pivot pin and upon a top side of the moveable blade so as to urge the moveable blade upon the fixed blade.

3. The device of claim 1 further including a positional flag (612) disposed upon the radial rotational plate and a sensor (735) disposed within the guide assembly.

4. The device of claim 3 with a trigger (240) in wired attachment to an electronics board (400) and the electronics board in wired attachment to the motor and the sensor.

5. The device of claim 4 wherein the electronics board includes a sub routine causing the motor to stop with the positional flag aligned with the sensor when the trigger is released.

6. The device of claim 5 with a receptacle (430) for external power attached to the electronics board.

7. The device of claim 6 with an auxiliary power supply (460) attached to the receptacle.

8. The device of claim 5 with a top cover (210) attached to the upper casing and a lower casing (220) attached to the upper casing.

* * * * *